US008749459B2

(12) United States Patent
Shin et al.

(10) Patent No.: US 8,749,459 B2
(45) Date of Patent: Jun. 10, 2014

(54) LIGHT EMITTING DISPLAY DEVICE INCLUDING A DUMMY PIXEL HAVING CONTROLLED BIAS

(75) Inventors: Hye-Jin Shin, Yongin-si (KR); Won-Kyu Kwak, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 859 days.

(21) Appl. No.: 11/688,325

(22) Filed: Mar. 20, 2007

(65) Prior Publication Data

US 2008/0036386 A1 Feb. 14, 2008

(30) Foreign Application Priority Data

Jul. 31, 2006 (KR) ..... 10-2006-0072078

(51) Int. Cl.
*G09G 3/32* (2006.01)

(52) U.S. Cl.
USPC ..... 345/82

(58) Field of Classification Search
USPC ..... 345/76, 77, 82; 315/169.3; 313/505
See application file for complete search history.

(56) References Cited

U.S. PATENT DOCUMENTS

| | | | | |
|---|---|---|---|---|
| 5,945,969 | A | 8/1999 | Westphal | 345/75.2 |
| 2004/0100463 | A1 | 5/2004 | Miyagawa et al. | 345/212 |
| 2005/0116902 | A1 | 6/2005 | Miyzawa | 345/76 |
| 2005/0184980 | A1 | 8/2005 | Sato et al. | 345/204 |
| 2005/0248693 | A1 | 11/2005 | Kurasawa | 345/39 |
| 2005/0258769 | A1 | 11/2005 | Imamura | 315/161 |
| 2006/0017672 | A1* | 1/2006 | Aoki | 345/77 |
| 2006/0050205 | A1* | 3/2006 | Yang et al. | 349/98 |
| 2006/0061524 | A1* | 3/2006 | Suh et al. | 345/76 |

FOREIGN PATENT DOCUMENTS

| | | |
|---|---|---|
| CN | 1210415 | 3/1999 |
| CN | 1658262 | 8/2005 |
| EP | 1 496 495 | 1/2005 |
| EP | 1 764 771 | 3/2007 |
| JP | 07-036406 | 2/1995 |
| JP | 09-090411 | 4/1997 |
| JP | 2005-141256 | 6/2005 |

(Continued)

OTHER PUBLICATIONS

Search Report issued by European Patent Office in European Patent Application No. 07253011.6-2205 on Apr. 21, 2009.

Choi, S.M. et al., "A Self-compensated Voltage Programming Pixel Structure for Active-Matrix Organic Light Emitting Diodes", IDW '03, Proceedings of The 10th International Display Workshops, The Society for Information Display, Dec. 3, 2003, pp. 535-538.

(Continued)

*Primary Examiner* — Allison W Johnson

(74) *Attorney, Agent, or Firm* — Christie, Parker & Hale, LLP

(57) ABSTRACT

A light emitting display includes a data driver, a scan driver, and a display. The data driver generates a data signal and transmits the data signal to data lines. The scan driver generates a first selection signal and transmits the first selection signal to first scan lines. The display includes the data lines and the first scan lines, first pixels, a first dummy pixel group, and a second dummy pixel group. The first pixels are defined by the data lines and the first scan lines. The first and second dummy pixel groups are respectively formed of dummy pixels, including pixel circuits, provided adjacent to the scan driver and the data driver. Each pixel circuit of the first dummy pixel group is applied with a voltage of a first power source. Each pixel circuit of the second dummy pixel group is applied with the voltage of the first power source.

14 Claims, 5 Drawing Sheets

(56) References Cited

FOREIGN PATENT DOCUMENTS

| | | |
|---|---|---|
| JP | 2006-065282 | 3/2006 |
| JP | 2006-065284 | 3/2006 |
| JP | 2007-052442 | 3/2007 |
| JP | 2007-140451 | 6/2007 |
| KR | 2004-70043 | 8/2004 |
| KR | 2006-19758 | 3/2006 |
| WO | WO 2004/023191 | 3/2004 |

OTHER PUBLICATIONS

Kim, Y. et al., "A New Current Programmable Pixel Structure for Large-Size and High-Resolution AMOLEDs", Proceedings of IDW'02, Dec. 4, 2002, pp. 367-370.

European Search Report dated Jul. 26, 2011, for corresponding European Patent application 07253011.6, noting references previously submitted or cited in an IDS or U.S. Office action, 7 pages.

* cited by examiner

LIGHT EMITTING DISPLAY DEVICE INCLUDING A DUMMY PIXEL HAVING CONTROLLED BIAS

CROSS-REFERENCE TO RELATED APPLICATIONS

This application claims the benefit of Korean Patent Application No. 2006-72078 filed in the Korean Intellectual Property Office on Jul. 31, 2006, the disclosure of which is incorporated herein by reference.

BACKGROUND OF THE INVENTION

1. Field of the Invention

An aspect of the present invention relates to a light emitting display device, and more particularly, relates to a light emitting display device having a dummy pixel in which the bias is controlled.

2. Description of the Related Art

In general, an organic light emitting diode (OLED) display is a display device using an organic material that emits light, and an image is displayed by voltage-driving or current-driving organic light emitting cells arranged in an N×M matrix. The organic light emitting cell is also called an organic light emitting diode (OLED) since it has diode characteristics, and has a structure having an anode, an organic thin film, and a cathode layer.

A display panel of a conventional OLED includes a plurality of dummy pixels in left and right sides of an area in which a plurality of pixels for emitting light are included. A selection signal is transmitted to the light emitting pixels through the dummy pixel. As a result, a load of a scan line that transmits the selection signal increases. Therefore, it is necessary to prevent a short circuit and current leakage of a transistor that forms the dummy pixel.

In particular, the load of the scan line increases because of the biased dummy pixel, thereby causing a scan signal delay. In addition, an insulator breakdown phenomenon may occur in the transistor and the capacitor of the dummy pixel, resulting in a short circuit due to a current leakage.

The above information disclosed in this Background section is only for enhancement of understanding of the background of the invention and therefore it may contain information that does not form the prior art that is already known in this country to a person of ordinary skill in the art.

SUMMARY OF THE INVENTION

An aspect of the present invention provides an organic light emitting diode (OLED) display eliminating short-circuits and current leakage in a dummy pixel by changing a bias condition of the dummy pixel to thereby prevent a scan signal delay.

A light emission display according to an embodiment of the present invention includes a data driver, a scan driver, and a display. The data driver generates a data signal and transmits the data signal to a plurality of data lines, respectively. The scan driver generates a first selection signal and transmits the first selection signal to a plurality of first scan lines, respectively. The display includes the plurality of data lines and the plurality of first scan lines, a plurality of first pixels, a first dummy pixel group, and a second dummy pixel group. The plurality of first pixels are defined by the data lines and the first scan lines. The first dummy pixel group is formed of a plurality of dummy pixels provided adjacent to the scan driver. The second dummy pixel group is formed of a plurality of dummy pixels provided adjacent to the data driver. Each pixel circuit of the first dummy pixel group is applied with a voltage of a first power source rather than being applied with the data signal and the first selection signal. Each pixel circuit of the second dummy pixel group is applied with the voltage of the first power source rather than being applied with the first selection signal.

According to another aspect of the present invention, a dummy pixel of the first dummy pixel group includes a light emitting diode, a first transistor, a second transistor, and a first capacitor. The light emitting diode emits light corresponding to a current applied to the light emitting diode, and has a first end applied with the voltage of the first power source. The first transistor has a first electrode and a control electrode applied with the voltage of the first power source. The second transistor has a second electrode coupled to a second end of the light emitting diode and a second electrode of the first transistor, and is applied with current corresponding to a voltage difference between a control electrode and a first electrode. The first capacitor has a first end coupled to the control electrode of the second transistor, and a second end applied with the voltage of the first power source.

According to another aspect of the present invention the display includes a plurality of light emission control lines that transmit a light emission control signal controlling the start of light emission of the first pixel.

According to another aspect of the present invention the pixel circuit of the first dummy pixel group further includes a third transistor and a fourth transistor. The third transistor has a first electrode and a second electrode respectively coupled between the second transistor and the light emitting diode, and a control electrode applied with the voltage of the first power source. The fourth transistor has a first electrode and a second electrode respectively coupled between the other end of the first capacitor and the second transistor, and a control electrode applied with the voltage of the first power source. The light emission display further includes a light emission control driver generating the light emission control signal, and a third dummy pixel group between the light emission control driver and the display. A pixel circuit of the third dummy pixel group is the same as that of the first dummy pixel group.

According to another aspect of the present invention in addition, the pixel circuit of the first dummy pixel group includes a fifth transistor and a sixth transistor. The fifth transistor has a second electrode coupled to the first end of the first capacitor, and a first electrode and a control electrode applied with the voltage of the first power source. The sixth transistor has a first electrode and a second electrode respectively coupled to the first electrode and the control electrode of the second transistor, and a control electrode applied with the voltage of the first power source.

According to another aspect of the present invention a dummy pixel of the second dummy pixel group includes a first light emitting diode, a first transistor, a second transistor, and a first capacitor. The first light emitting diode emits light corresponding to current applied thereto, and has a first end applied with the voltage of the first power source. The first transistor has a control electrode applied with the voltage of the first power source, a first floating electrode, and a second electrode coupled to a second end of the first light emitting diode. The second transistor has a current generated corresponding to a voltage difference between a control electrode and a first electrode of the second transistor, and transmits the current to the first light emitting diode. The first capacitor has a first end coupled to the control electrode of the second transistor, and a floating second end.

According to another aspect of the present invention the pixel circuit of the second dummy pixel group includes a third transistor and a fourth transistor. The third transistor has a first electrode and a second electrode respectively coupled between the second transistor and the light emitting diode, and a control electrode applied with the voltage of the first power source. The fourth transistor has a first floating electrode, a second electrode coupled to the first electrode of the second transistor, and a control electrode applied with the voltage of the first power source.

According to another aspect of the present invention the pixel circuit of the second dummy pixel group further includes a fifth transistor and a sixth transistor. The fifth transistor has a second electrode coupled to the first end of the first capacitor, a first electrode applied with the voltage of the first power source, and a control electrode applied with the selection signal. The sixth transistor has a first electrode and a second electrode respectively coupled to the first electrode and the control electrode of the second transistor, and a control electrode applied with the voltage of the power source.

According to another aspect of the present invention the pixel circuit of the first dummy pixel group includes a first light emitting diode, a first transistor, a second transistor, and a first capacitor. The first light emitting diode emits light corresponding to a current applied thereto, and has a first end applied with the voltage of the first power source. The first transistor has a first electrode and a control electrode applied with the voltage of the first power source. The second transistor has a second electrode coupled to a second end of the first light emitting diode and the second electrode of the first transistor, and is applied with a current corresponding to a voltage difference between a control electrode and a first electrode. The first capacitor has a first end coupled to the control electrode of the second transistor and a second end applied with the voltage of the first power source.

According to another aspect of the present invention the light emission display further includes a light emission control driver and a third dummy pixel group. The light emission control driver generates the light emission control signal. The third dummy pixel group is provided between the light emission control driver and the display.

According to another aspect of the present invention a pixel circuit of the third dummy pixel group is the same as the pixel circuit of the first dummy pixel group.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
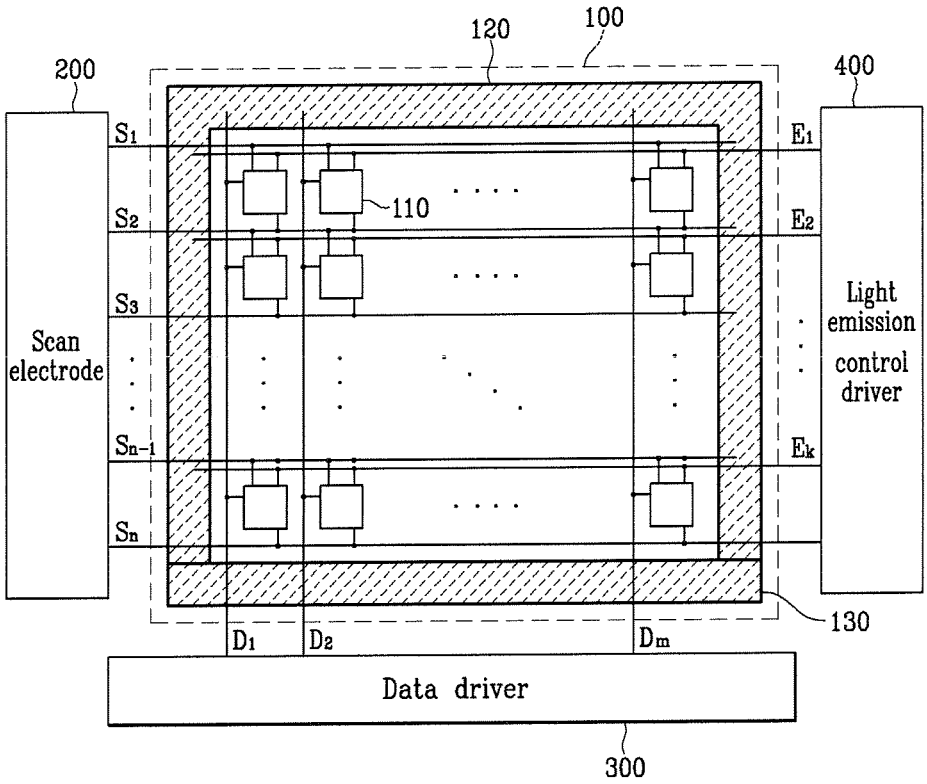
FIG. 1 schematically shows an organic light emitting diode (OLED) display according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

In the following detailed description, only certain embodiments of the present invention have been shown and described, simply by way of illustration. As those skilled in the art would realize, the described embodiments may be modified in various different ways, all without departing from the spirit or scope of the present invention. To clarify the present invention, parts that are not described in the specification are omitted, and parts for which similar descriptions are provided have the same reference numerals.

Throughout this specification and the claim that follow, when it is described that an element is coupled to another element, the element may be directly coupled to the other element or electrically coupled to the other element through a third element. Throughout this specification and claims which follow, unless explicitly described to the contrary, the word "comprise/include" or variations such as "comprises/includes" or "comprising/including" will be understood to imply the inclusion of stated elements but not the exclusion of any other elements.

An organic light emitting diode (OLED) display and a pixel circuit according to an embodiment of the present invention will now be described in detail with reference to the accompanying drawings.

FIG. 1 schematically shows an OLED display according to an embodiment of the present invention.

As shown in FIG. 1, the OLED display includes a display 100, a scan driver 200, a data driver 300, and a light emission control driver 400.

The display 100 includes a plurality of data lines $D_1$ to $D_m$ extending in a column direction, and a plurality of scan lines $S_1$ to $S_n$ and light emission control lines $E_1$ to $E_n$ extending in a row direction. The display 100 further includes a plurality of pixels formed at crossing parts of the data lines $D_1$ to $D_m$ and the scan lines $S_1$ to $S_n$, and each pixel is connected to the plurality of data lines $D_1$ to $D_m$, the plurality of scan lines $S_1$ to $S_n$, and the plurality of light emission control lines $E_1$ to $E_n$, respectively. Each pixel includes a pixel circuit 110. In addition, the display 100 includes a first dummy pixel group 120 and a second dummy pixel group 130, wherein the first dummy pixel group 120 is formed of a plurality of pixels formed in an upper portion of the display 100, between the display 100 and the scan driver 200 and between the display 100 and the light emission control driver 400, and the second dummy pixel group 130 is formed of a plurality of pixels formed between the data driver 300 and the display 100. The data lines $D_1$ to $D_m$ transmit data signals representing video signals to the pixel circuit 110, the scan lines $S_1$ to $S_f$ transmit selection signals to the pixel circuit 110, and the light emission control lines $E_1$ to $E_k$ transmit a light emission control signal to the pixel circuit 110.

In order to express colors, each pixel represents a unique color among primary colors or alternately represents a primary color with respect to time, and thus a desired color is expressed by temporally or spatially combining the primary colors. The primary colors, for example, include red (R), green (G), and blue (B). When a color is expressed by temporally combining colors, a pixel alternately displays R, G, and B with respect to time. When a color is expressed by spatially combining colors, a color is expressed by three pixels, which are an R pixel, a G pixel, and a B pixel. Herein, each pixel is called a sub-pixel, and one pixel is formed of these three sub-pixels. In addition, when the color is expressed by spatially combining colors, the R pixel, G pixel, and B pixel may be alternately arranged in a row direction or a column direction, or the three pixels may be located at respective angular points of a triangle.

The scan driver 200 generates selection signals and sequentially applies the selection signals to the scan lines $S_1$ to $S_n$. Herein, a scan line applied with a current selection signal is called a current scan line, and a scan line applied with a previous selection signal is called a previous scan line.

The data driver 300 generates a data voltage corresponding to the image signal and transmits the data voltage to the data lines $D_1$ to $D_m$.

The light emission control driver 400 sequentially applies the light emission control signal to the light emission control lines $E_1$ to $E_k$ so as to control light emission of organic light emitting diodes.

The scan driver 200, the data driver 300, and/or the light emission control driver 400 may be electrically connected to the display panel 100, and may also be mounted as a chip on a tape carrier package (TCP), a flexile printed circuit (FPC), or a film attached and electrically coupled to the substrate of the display panel 100. On the other hand, the scan driver 200, the data driver 300, and/or the light emission control driver 400 may be directly attached to a substrate of the display panel 100, and they may be realized as a driving circuit formed on a substrate and having a layer structure similar to scan lines, data lines, light emission control lines, and a thin film transistor.

Figure 2:
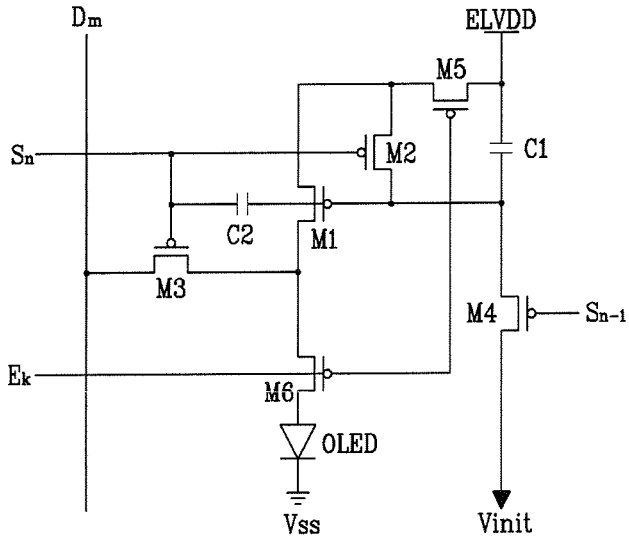
FIG. 2 shows a pixel circuit of according to an embodiment of the present invention.

FIG. 2 shows a circuit of the pixel 110 according to the embodiment of the present invention.

As shown in FIG. 2, the pixel circuit 110 includes six transistors M1 to M6, two capacitors C1 and C2, and an organic light emitting element (OLED). Herein, the six transistors M1 to M6 are provided as p-channel metal oxide semiconductor (PMOS) transistors. The transistors M1 to M6 each have two electrodes respectively forming a source electrode and a drain electrode, and a control electrode. The organic light emitting element is called an organic light emitting diode since it has diode characteristics, and has a structure having an anode, an organic thin film, and a cathode.

As a driving transistor for driving the OLED, the transistor M1 is coupled between a power source ELVDD and the OLED, and a voltage difference between a gate electrode and a source electrode of the transistor M1 generates current flowing to the OLED. The power source ELVDD supplies a voltage of ELVDD. The transistor M4 is coupled between the power source ELVDD and a power source Vinit that supplies an initial voltage of Vinit, and is turned on/off in response to the selection signal from a previous scan line $S_{n-1}$.

When the transistor M4 is turned on, the initial voltage Vinit is transmitted to a gate of the transistor M1. The transistor M2 is turned on/off in response to the selection signal from a current scan line $S_n$, and is coupled between the gate electrode and the source electrode of the transistor M1. The transistor M3 is turned on/off in response to the selection signal from the current scan line $S_n$, and is coupled between a data line and a drain electrode of the transistor M1. The transistor M3 transmits a data voltage VDATA to the drain electrode of the transistor M1 in response to the selection signal from the current scan line $S_n$. The transistor M5 couples the transistor M1 and the power source ELVDD in response to the light emission control signal from the light emission control line $E_k$. The transistor M6 is coupled between the transistor M1 and the OLED, and transmits current to the OLED through the transistor M1 in response to the light emission control signal from the light emission control line $E_k$.

The capacitor C1 is coupled between the transistor M4 and the power source ELVDD supplying the voltage ELVDD. When the transistor M4 is turned on, the capacitor C1 is charged with a voltage (ELVDD−Vinit) that corresponds to a voltage difference between the voltage ELVDD and the initial voltage Vinit, and the voltage between the gate electrode of the transistor M1 and the power source supplying the voltage ELVDD is consistently maintained. The capacitor C2 has a first electrode coupled to the current scan line $S_n$ and a second electrode coupled to the gate electrode of the transistor M1. The capacitor C2 maintains a voltage difference between the selection signal from the current scan line $S_n$ and the gate of the transistor M1. The OLED is coupled between a drain of the transistor M6 and the power source VSS.

In the pixel circuit 110 according to the embodiment of the present invention, a voltage level of the power source ELVDD is greater than that of the power source VSS.

An operation of the pixel circuit 110 will now be described with reference to FIG. 3.

Figure 3:
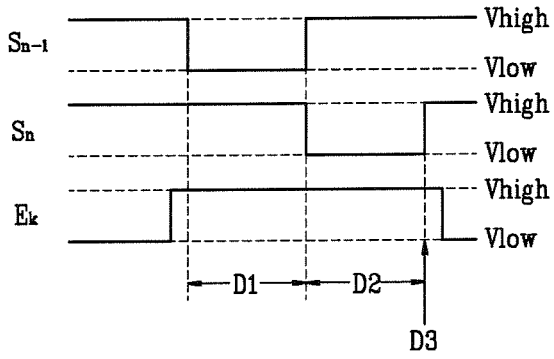
FIG. 3 shows a signal waveform applied to a pixel circuit.

FIG. 3 shows a signal waveform applied to the pixel circuit 110.

When a scan voltage of a selection signal of a low level (i.e., an enable level) is applied from the previous scan line $S_{n-1}$ during a period D1, the transistor M4 is turned on and an end of the capacitor C1 is initialized with the initial voltage Vinit and charged with a voltage (ELVDD−Vinit) that corresponds to a voltage difference between the voltage ELVDD of the power source and the initial voltage Vinit.

Subsequently, during a period D2, a selection signal from the current scan line $S_n$ becomes a low level (e.g., an enable level, Vlow), and thus the transistors M2 and M3 are turned on. When the transistor M2 is turned on, the transistor M1 is diode-connected and a data voltage VDATA is applied to the transistor M1 through the transistor M3. Then, a voltage is applied to a gate of the diode-connected transistor M1. The voltage corresponds to a sum of the data voltage VDATA and a threshold voltage VTH. Accordingly, both ends of the capacitor C2 are respectively applied with the gate voltage (VDATA+VTH) and the voltage Vlow, and thus the capacitor C2 is charged with a voltage of (VDATA+VTH−Vlow).

After a point of time D3, the selection signal from the current scan line $S_n$ becomes a high level (i.e., a disable level, Vhigh) and the light emission signal from the light emission control line $E_k$ becomes the enable level Vlow, and thus the transistors M5 and M6 are turned on in response to the light emission control signal. The source electrode of the transistor M1 is applied with the voltage ELVDD, and the voltage (VDATA+VTH) being applied to the gate electrode during the period D2 is changed as the selection signal from the current scan line $S_n$ becomes the high level Vhigh.

When the selection signal from the current scan line $S_n$ is changed from the low level Vlow to the high level Vhigh, a voltage at a node of the capacitor C2 and the current scan line $S_n$ is increased by an increased amount $\Delta V_S$ of the selection signal level. Therefore, a gate voltage $V_G$ of the transistor M1 is increased compared to the voltage during the period D2 due to the coupling of the capacitors C1 and C2, and an increased amount $\Delta V_G$ of the gate voltage $V_G$ is calculated by Equation 1.

$$\Delta V_G = \frac{\Delta V_S C_1}{C_1 + C_2} \quad \text{[Equation 1]}$$

Since the gate voltage $V_G$ of the transistor M1 is increased by $\Delta V_G$, current $I_{OLED}$ flowing to the transistor M1 can be calculated by Equation 2. That is, a voltage level of a gate-source voltage $V_{GS}$ of the transistor M1 is changed as much as a voltage level of the gate voltage $V_G$ of the transistor M1 is changed, and the drain current $I_{OLED}$ is also changed accordingly.

$$I_{OLED} = \frac{\beta}{2}(V_{GS} + \Delta V_G - V_{TH})^2 = \frac{\beta}{2}(VDATA - ELVDD + \Delta V_G)^2 \quad \text{[Equation 2]}$$

Pixels of the first dummy group 120 and the second dummy group 130 according to the embodiment of the present invention will now be respectively described with reference to FIG. 4 and FIG. 5. One portion of a plurality of dummy pixels and the other portion of a plurality of dummy pixels in the display 100 are respectively grouped into the first dummy pixel group 120 and the second dummy pixel group 130 according to the present embodiment, which is not restrictive.

Figure 4:
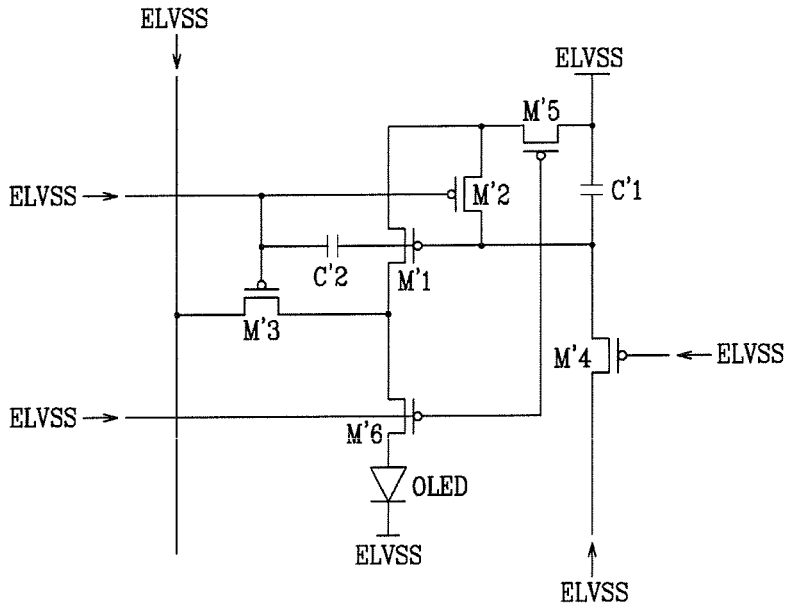
FIG. 4 shows a random pixel circuit of a first dummy pixel group.

FIG. 4 shows a random pixel circuit in the first dummy pixel group 120.

In contrast to the pixel circuit 110 of the display 100, the pixel circuit of the first dummy pixel group 120 has a selection signal, a light emission control signal, a data signal line, and a power source coupled to power sources that supply the same voltage.

In more detail, a power source ELVSS rather than the power source ELVDD is coupled to an end of a first capacitor C1, and thus a voltage ELVSS of the power source ELVSS rather than the data voltage VDATA is applied thereto. In addition, the voltage of the power source ELVSS replaces the selection signal from the current scan line $S_n$, the selection signal from the previous scan line $S_{n-1}$, and the light emission control signal from the light emission control line $E_k$.

In addition, the voltage of the power source ELVSS replaces the initial voltage Vinit.

A cathode electrode of on OLED is coupled to the power source ELVSS.

Then, a gate electrode and a source electrode of a transistor M'5 are applied with the same level of voltage, and thus the transistor M'5 is maintained at the turn-off state. A gate electrode and a source electrode of a transistor M'3 are applied with the same level of voltage, and thus the transistor M'3 is maintained at the turn-off state. In addition, although a transistor M'4 is turned on by the power voltage ELVSS, both ends of a first capacitor C'1 are applied with the same level of voltage and thus the first capacitor C'1 is not charged. At this time, although a transistor M'2 is turned on by the voltage ELVSS and thus the transistor M'1 is diode-connected, a short-circuit due to current leakage does not occur because current does not flow toward an anode of the OLED.

As described, the pixel circuit of the first dummy pixel group is not coupled to a scan line that transmits a selection signal and is applied with the same level of voltage, and therefore a load of each scan line due to the dummy pixel can be eliminated. Therefore, a selection signal can be transmitted to each scan line without causing a delay. In addition, unexpected light emission of the OLED due to the current leakage in the dummy pixel can be prevented.

Figure 5:
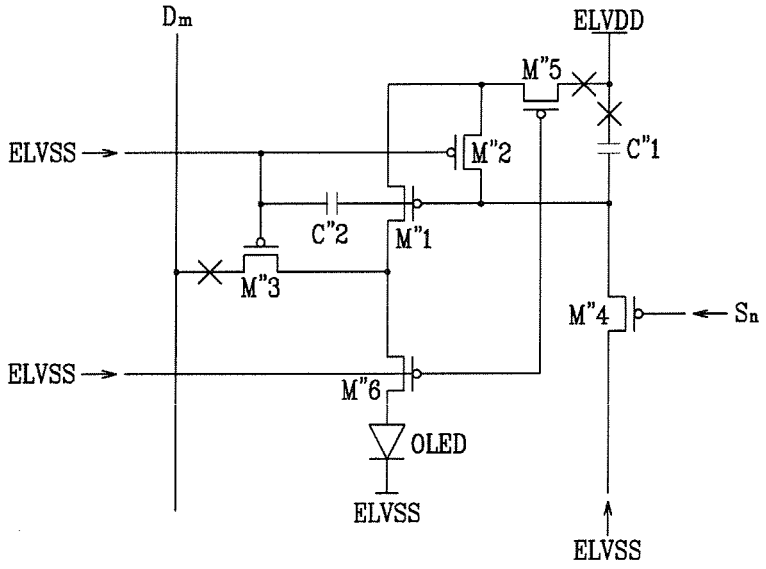
FIG. 5 shows a random pixel circuit of a second dummy pixel group.

FIG. 5 shows a pixel circuit of the second dummy pixel group 130.

Compared to the pixel 110 of the display 100, a current selection signal, a light emission control signal, an initial voltage OLED transmitted to a pixel circuit of the second dummy pixel group 130 and a cathode electrode of an OLED of the pixel circuit are coupled to a power source that supplies the same level of voltage. A power source ELVDD, a data voltage VDATA, and a selection signal from a previous scan line $S_{n-1}$ are transmitted to the pixel circuit of the second dummy pixel group 130. In addition, a contact hole coupling the power source ELVDD and a source electrode of a transistor M"5, a contact hole coupling the power source ELVDD and an end of a first capacitor C"1, and a contact hole coupling the data lines D1 to Dm and a source electrode of the transistor M"3 are not formed. That is, the source electrode of the transistor M"5, a first electrode of the transistor M"3, and an end of the capacitor C"1 are floating.

Therefore, a voltage of the power source ELVDD is not applied to the source electrode of the transistor M"1, or the data voltage VDATA is not applied to the drain electrode of the transistor M"1. Since one end of the first capacitor C"1 is floating, a voltage difference at both ends of the first capacitor C"1 cannot be consistently maintained and accordingly the first capacitor C"1 cannot be charged.

In addition, instead of a selection signal from a current scan line (not shown) and a light emission control signal from a light emission control line $E_k$, a voltage of the power source ELVSS is applied to the pixel circuit of the second dummy pixel group. The voltage of the power source ELVSS replaces the initial voltage Vinit, and a cathode of the OLED is coupled to the power source ELVSS.

When a selection signal of the enable level from a scan line $S_n$ is applied to the transistor M"4 and thus the transistor M"4 is turned on, the other end of the first capacitor C"1 is applied with the voltage of the power source ELVSS. At this time, although the transistor M"2 is turned on by the voltage of the power source ELVSS and thus the transistor M"1 is diode-connected, current does not flow toward the anode of the OLED and thus an occurrence of a short-circuit due to the current leakage can be prevented.

The second dummy pixel group 130 according to the embodiment of the present invention is provided between the data driver 300 and the display 100, and the second dummy pixel group 130 is applied with the selection signal $S_n$ rather than the voltage of the power source ELVSS so as to balance loads between the scan line $S_n$ that transmits the selection signal to the second dummy pixel group 130 and the plurality of scan lines that transmit the selection signals to the plurality of scan lines S1 to Sn-1 in the light emitting state.

As described, although the pixel circuits of the second dummy pixel group are coupled to the scan line that transmits the selection signal for load balance, the pixel circuits do not emit light because they are applied with the same voltage.

Light emission of the OLED due to current leakage in the dummy pixel can also be avoided.

That is, a load of the scan line caused by the plurality of dummy pixels in the non-light emission state can be eliminated according to an aspect of the present embodiment. Therefore, the OLED display according to the embodiment of the present invention can transmit the selection signals to the plurality of pixels without causing a delay. In addition, there is no change of light emission in the OLED of the dummy pixel since no current leakage that causes a short-circuit occurs in the dummy pixel.

Although it has been described that the pixel circuit according to the embodiment of the present invention includes six transistors and two capacitors, a pixel circuit with a different configuration may also be applied to the present invention in a similar way as described above.

According to the embodiment of the present invention, a load of a scan line caused by a dummy pixel is eliminated and thus an OLED display can transmit a selection signal without a delay.

In addition, light emission of the dummy pixel due to current leakage in the OLED display can also be prevented according to the embodiment of the present invention.

Although the embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A light emitting display comprising:

a data driver for generating a data signal and for transmitting the data signal to a plurality of data lines;

a scan driver for generating a first selection signal and for transmitting the first selection signal to a plurality of first scan lines; and a display comprising:

the plurality of data lines and the plurality of first scan lines;

a plurality of first pixels coupled to the data lines and to the first scan lines;

a first dummy pixel group comprising a plurality of dummy pixels comprising pixel circuits each comprising a light emitting diode configured to receive a voltage of a first power source, the first dummy pixel group being adjacent the scan driver; and a second dummy pixel group comprising a plurality of dummy pixels comprising pixel circuits adjacent the data driver, wherein each pixel circuit of the first dummy pixel group and each pixel circuit of the second dummy pixel group are applied with the voltage of the first power source, and wherein each of the pixel circuits of the first dummy pixel group comprises:

the light emitting diode for emitting light corresponding to a current applied to the light emitting diode and having a first end applied with the voltage of the first power source;

a first transistor having a first electrode and a control electrode applied with the voltage of the first power source;

a second transistor having a second electrode coupled to a second end of the light emitting diode and to a second electrode of the first transistor, and applied with current corresponding to a voltage difference between a control electrode thereof and a first electrode thereof; and a first capacitor having a first end coupled to the control electrode of the second transistor and a second end coupled to the first power source.

2. The light emitting display of claim 1, wherein both ends of the first capacitor are applied with a same voltage, thereby preventing the first capacitor from charging.

3. The light emitting display of claim 1, wherein the display comprises a plurality of light emission control lines configured to transmit light emission control signals for controlling a start of light emission of the first pixels, and wherein the pixel circuit of the first dummy pixel group further comprises:

a third transistor having a first electrode and a second electrode respectively coupled between the second transistor and the light emitting diode, and a control electrode applied with the voltage of the first power source; and a fourth transistor having a first electrode coupled to the first end of the first capacitor, and a control electrode applied with the voltage of the first power source.

4. The light emitting display of claim 3, wherein a gate electrode and a source electrode of the third transistor are applied with a same voltage, thereby maintaining the third transistor at a turn-off state.

5. The light emitting display of claim 3, further comprising:

a light emission control driver for generating the light emission control signal; and a third dummy pixel group provided between the light emission control driver and the display, wherein a pixel circuit of the third dummy pixel group comprises:

a light emitting diode for emitting light corresponding to a current applied to the light emitting diode, and having a first end applied with the voltage of the first power source;

a first transistor having a first electrode and a control electrode applied with the voltage of the first power source;

a second transistor having a second electrode coupled to a second end of the light emitting diode and to a second electrode of the first transistor, and applied with current corresponding to a voltage difference between a control electrode thereof and a first electrode thereof;

a third transistor having a first electrode and a second electrode respectively coupled to the second transistor and to the light emitting diode, and a control electrode applied with the voltage of the first power source;

a fourth transistor having a first electrode coupled to the first end of a first capacitor, and a control electrode applied with the voltage of the first power source; and the first capacitor having a first end coupled to the control electrode of the second transistor and a second end coupled to the first power source.

6. The light emitting display of claim 5, wherein the scan driver, the data driver, and the light emission control driver are mounted as a chip on a tape carrier package, a flexible printed circuit, or a film attached and electrically coupled to a substrate of the light emitting display.

7. The light emitting display of claim 3, wherein the pixel circuit of the first dummy pixel group further comprises:

a fifth transistor having a second electrode coupled to the first end of the first capacitor, and a first electrode and a control electrode applied with the voltage of the first power source; and a sixth transistor having a first electrode and a second electrode respectively coupled to the first electrode and to the control electrode of the second transistor, and a control electrode applied with the voltage of the first power source.

8. The light emitting display of claim 7, further comprising:

a light emission control driver for generating the light emission control signal; and a third dummy pixel group provided between the light emission control driver and the display, wherein a pixel circuit of the third dummy pixel group comprises:

a light emitting diode for emitting light corresponding to a current applied to the light emitting diode, and having a first end applied with the voltage of the first power source;

a first transistor having a first electrode and a control electrode applied with the voltage of the first power source;

a second transistor having a second electrode coupled to a second end of the light emitting diode and to a second electrode of the first transistor, and applied with current corresponding to a voltage difference between a control electrode thereof and a first electrode thereof;

a third transistor having a first electrode and a second electrode respectively coupled to the second transistor and to the light emitting diode, and a control electrode applied with the voltage of the first power source;

a fourth transistor having a first electrode coupled to the first end of a first capacitor, and a control electrode applied with the voltage of the first power source; and the first capacitor having a first end coupled to the control electrode of the second transistor and a second end applied with the voltage of the first power source.

9. The light emitting display of claim 7, wherein a gate electrode and a source electrode of the fifth transistor are applied with a same voltage, thereby maintaining the fifth transistor at a turn-off state.

10. A light emitting display comprising:

a data driver for generating a data signal and for transmitting the data signal to a plurality of data lines;

a scan driver for generating a first selection signal and for transmitting the first selection signal to a plurality of first scan lines; and a display comprising:

the plurality of data lines and the plurality of first scan lines;

a plurality of first pixels coupled to the data lines and to the first scan lines;

a first dummy pixel group comprising a plurality of dummy pixels comprising pixel circuits each comprising a light emitting diode configured to receive a voltage of a first power source, the first dummy pixel group being adjacent the scan driver; and a second dummy pixel group comprising a plurality of dummy pixels comprising pixel circuits adjacent the data driver, wherein each pixel circuit of the first dummy pixel group and each pixel circuit of the second dummy pixel group are applied with the voltage of the first power source, and wherein the pixel circuit of the second dummy pixel group comprises:

a first light emitting diode for emitting light corresponding to a current applied thereto, and having a first end applied with the voltage of the first power source;

a first transistor having a control electrode applied with the voltage of the first power source, a first floating electrode, and a second electrode coupled to a second end of the first light emitting diode;

a second transistor for having a current generated corresponding to a voltage difference between a control electrode of the second transistor and a first electrode of the second transistor, and for transmitting the current to the first light emitting diode; and a first capacitor having a first end coupled to the control electrode of the second transistor and a floating second end.

11. The light emitting display of claim 10, wherein the display further comprises a plurality of light emission control lines for transmitting a light control signal for controlling a start of light emission of the first pixel, and wherein the pixel circuit of the second dummy pixel group further comprises:

a third transistor having a first electrode and a second electrode respectively coupled to the second transistor and to the light emitting diode, and a control electrode applied with the voltage of the first power source; and a fourth transistor having a first floating electrode, a second electrode coupled to the first electrode of the second transistor, and a control electrode applied with the voltage of the first power source.

12. The light emitting display of claim 11, wherein the pixel circuit of the second dummy pixel group further comprises:

a fifth transistor having a second electrode coupled to the first end of the first capacitor, a first electrode applied with the voltage of the first power source, and a control electrode applied with the selection signal; and a sixth transistor having a first electrode and a second electrode respectively coupled to the first electrode of the second transistor and to the control electrode of the second transistor, and a control electrode applied with the voltage of the power source.

13. The light emitting display of claim 12, wherein the pixel circuit of the first dummy pixel group comprises:

a first light emitting diode for emitting light corresponding to a current applied thereto, and having a first end applied with the voltage of the first power source;

a first transistor having a first electrode and a control electrode applied with the voltage of the first power source;

a second transistor having a second electrode coupled to a second end of the first light emitting element and to the second electrode of the first transistor, and applied with a current flow corresponding to a voltage difference between a control electrode and a first electrode; and a first capacitor having a first end coupled to the control electrode of the second transistor and a second end applied with the voltage of the first power source.

14. The light emitting display of claim 13, further comprising:

a light emission control driver for generating a light emission control signal; and a third dummy pixel group between the light emission control driver and the display, wherein a pixel circuit of the third dummy pixel group comprises:

a light emitting diode for emitting light corresponding to a current applied to the light emitting diode, and having a first end applied with the voltage of the first power source;

a first transistor having a first electrode and a control electrode applied with the voltage of the first power source;

a second transistor having a second electrode coupled to a second end of the light emitting diode and to a second electrode of the first transistor, and applied with current corresponding to a voltage difference between a control electrode and a first electrode;

a third transistor having a first electrode and a second electrode respectively coupled to the second transistor and to the light emitting diode, and a control electrode applied with the voltage of the first power source;

a fourth transistor having a first electrode coupled to the first end of the first capacitor, and a control electrode applied with the voltage of the first power source; and a first capacitor having a first end coupled to the control electrode of the second transistor and a second end applied with the voltage of the first power source.

* * * * *